US008147312B2

(12) United States Patent
Nadeau et al.

(10) Patent No.: US 8,147,312 B2
(45) Date of Patent: Apr. 3, 2012

(54) SYSTEM AND METHOD FOR PLAYING AN INTERACTIVE GAME WITH THE PROSPECT OF WINNING A PROGRESSIVE JACKPOT PRIZE AWARD

(75) Inventors: Andre Nadeau, Verdun (CA); Michel Provencher, Montreal (CA); Lyse Trudel, Montreal (CA); David Brouillard, Montreal (CA)

(73) Assignee: Oberthur Gaming Technologies Inc., Montreal, Quebec (CA)

( * ) Notice: Subject to any disclaimer, the term of this patent is extended or adjusted under 35 U.S.C. 154(b) by 830 days.

(21) Appl. No.: 11/521,108

(22) Filed: Sep. 14, 2006

(65) Prior Publication Data

US 2008/0096627 A1 Apr. 24, 2008

(51) Int. Cl.
*A63F 9/24* (2006.01)

(52) U.S. Cl. ..... 463/16; 463/20; 463/40; 463/42

(58) Field of Classification Search ..... 463/17, 463/26, 29, 39, 40, 30, 16, 20, 42
See application file for complete search history.

(56) References Cited

U.S. PATENT DOCUMENTS

| | | | | |
|---|---|---|---|---|
| 5,569,082 | A | 10/1996 | Kaye | |
| 5,709,603 | A | 1/1998 | Kaye | |
| 5,949,042 | A | 9/1999 | Dietz, II et al. | |
| 6,527,175 | B1 | 3/2003 | Dietz et al. | |
| 6,780,111 | B2 | 8/2004 | Cannon et al. | |
| 7,008,317 | B2 | 3/2006 | Cote et al. | |
| 2003/0060286 | A1 * | 3/2003 | Walker et al. | 463/42 |
| 2004/0242320 | A1 * | 12/2004 | Jackson | 463/26 |
| 2005/0101383 | A1 * | 5/2005 | Wells | 463/39 |
| 2005/0209008 | A1 * | 9/2005 | Shimizu et al. | 463/43 |
| 2005/0250571 | A1 * | 11/2005 | Kane et al. | 463/17 |
| 2006/0014579 | A1 * | 1/2006 | Kane et al. | 463/17 |
| 2007/0259711 | A1 * | 11/2007 | Thomas | 463/22 |

* cited by examiner

*Primary Examiner* — Dmitry Suhol
*Assistant Examiner* — Brandon Gray
(74) *Attorney, Agent, or Firm* — Dority & Manning, P.A.

(57) ABSTRACT

A method and system for playing an interactive game includes inputting into a host computer an access code, wherein the access code is operatively associated with game data storing a predetermined outcome of a game play, transmitting from the host computer a game play for play by a player on a terminal device in response to the inputted access code, and increasing the amount of a progressive jackpot in response to the occurrence of at least one game playing event.

26 Claims, 7 Drawing Sheets

SYSTEM AND METHOD FOR PLAYING AN INTERACTIVE GAME WITH THE PROSPECT OF WINNING A PROGRESSIVE JACKPOT PRIZE AWARD

FIELD OF THE INVENTION

The present invention relates generally to online gaming systems, and more particularly to a system and method for playing an interactive game including lottery/casino type games in an online environment which allows players to play games anywhere, while offering to the players the prospect of winning a progressive jackpot award to simulate the thrills and excitement typically associated with live casino gaming.

BACKGROUND OF THE INVENTION

Lotteries provide games of chance in which a player purchases a chance to win, and a single event displays the outcome of the game. Typical lotteries are operated through distribution of game pieces or tokens wherein a subset of the distributed tokens may win a prize. The game piece may be in the form of a ticket. One of the most popular forms of lottery involves the distribution of lottery tickets. Each lottery ticket includes a lottery number. After the lottery tickets have been distributed to the lottery ticket holders, the winning number is chosen. The usual method of selecting the winning number involves a random selection of the winning number. A random number generator can be used to randomly select the winning number. However, interest in purchasing lottery tickets is generally limited and typically stimulated only when the prize becomes substantial.

The popularity of gaming has exploded during recent years as players seek out more exciting and attractive games of chance. The result has been the consistent opening of new casinos throughout the United States and worldwide. In fact, casinos have been built at a record pace to keep up with the seemingly endless demand. The steady demand has also proliferated the creation of new wagering games. To intrigue players, such games are typically easy to play, quick to play and involve an attractive theme.

While casinos have enjoyed great success in the United States and around the world, many potential players are still discouraged from participating because of the time and effort needed to travel to the casino sites which may not be convenient for many. Players want a game that has variety, excitement, a multi-sensory game display, which provides players with options and choices like those experienced in casinos.

Accordingly, there continues to be a need for a system and method for playing an interactive game including lottery/casino type games in an online environment that simulate the attraction and thrill typically associated with live casino games by offering to the players the prospect of winning a progressive jackpot prize. There is a further need for a system and method for playing an interactive game including lottery/casino type games in an online environment that is simple to conduct, involves an attractive theme, and greatly enhances player convenience and ease of access, while helping to eliminate fraud, increase sales and maintain control over inventory.

SUMMARY OF THE INVENTION

The present invention relates generally to a system and method for playing an interactive game including lottery/casino type games in an online environment while offering to the players the prospect of winning a progressive jackpot prize award. The method and system of the present invention is designed to simulate the attraction and thrill typically associated with live casino games including an incremental increase in jackpot prizes in response to a game playing event. The method and system of the present invention is intended to be used in connection with progressive jackpots and optionally in combination with fixed payouts which may be characterized in the form of various prize structures which may include low tier and high tier prizes. The method of the present invention generally comprises distributing an access code to a player wherein the access code is entered to initiate the games via a terminal device personal to the player at any location including the home, the office or even locations where live casino games are typically held (i.e., casinos and gaming resorts). The access code may be distributed on a substrate such as a ticket or game piece or token, or distributed electronically online. Once the access code is validated and accepted, the player can initiate a game to play on the terminal device which may be represented as a game play event.

In accordance with one aspect of the present invention, each game play event as defined hereinafter initiates an incremental increase in the progressive jackpot prize by a preset amount, and the total jackpot prize amount is displayed to the players in real-time manner to simulate the excitement and thrills typically associated with live casino games. The system and method of the present invention is simple to conduct, involves an attractive theme, and greatly enhances player convenience and ease of access, while helping to eliminate fraud, increase sales and maintain control over inventory.

In one aspect of the present invention, there is provided a method for playing an interactive game, comprising:

a) inputting into a source an access code, the access code operatively associated with game data;

b) transmitting from the source a game play for play by a player on a terminal device in response to the inputted access code; and c) increasing the amount of a progressive jackpot in response to the occurrence of at least one game playing event.

In another aspect of the present invention, there is provided a system for playing an interactive game, comprising:

a) an access code operatively associated with game data;

b) inputting means for inputting into a terminal device the access code to initiate a game play for display on the terminal device;

c) means for transmitting the game play from a source to the terminal device; and d) game play initiation means for initiating a game play; and e) progressive jackpot increasing means for increasing the amount of the progressive jackpot in response to the occurrence of at least one game playing event.

BRIEF DESCRIPTION OF THE DRAWINGS

The following drawings are illustrative of embodiments of the present invention and are not intended to limit the invention as encompassed by the claims forming part of the application.

DETAILED DESCRIPTION OF THE INVENTION

Figure 1:
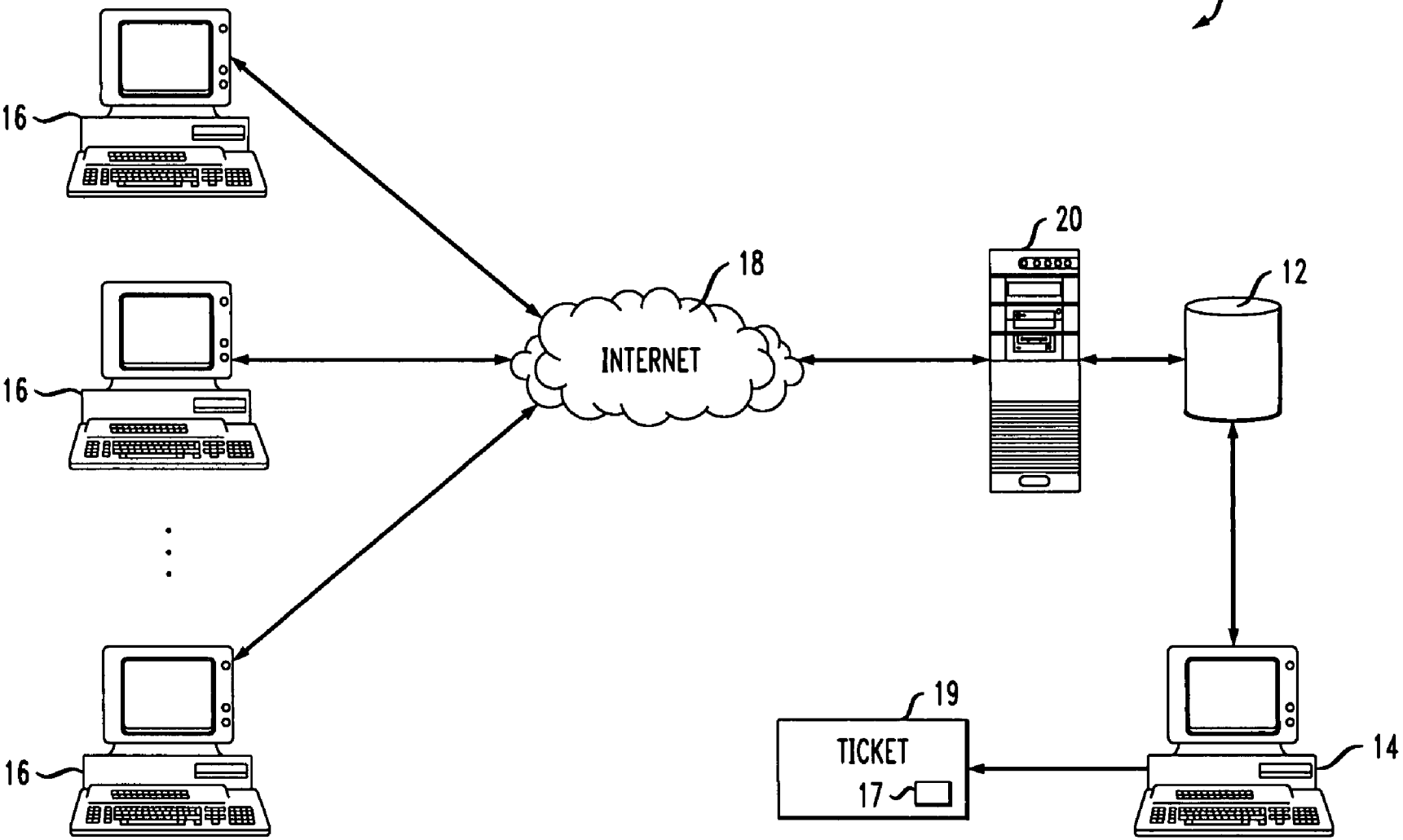
FIG. 1 is a block diagram showing hardware arrangement by which a player can play an interactive game in accordance with the present invention.

The present invention is directed to a method and system for playing an interactive game including lottery/casino type games in an online environment with the prospect of winning a progressive jackpot prize award. The method and system of the present invention is designed to simulate the attraction and thrill typically associated with live casino games including an incremental increase in progressive jackpot prizes in response to a game playing event. The method and system of the present invention is intended to be used in connection with progressive jackpots and optionally in combination with fixed payouts which may be characterized in the form of various prize structures which may include low tier and high tier prizes.

The method of the present invention generally comprises distributing an access code to a player wherein the access code is entered to initiate the games via a terminal device personal to the player at any location including the home, the office or even locations where live casino games are typically held (i.e., casinos and gaming resorts). The access code may be distributed on a substrate such as a ticket or game piece or token, or distributed electronically online. Once the access code is validated and accepted, the player can initiate a game to play on the terminal device, which may be represented as a game play event when incrementally increasing the progressive jackpot prize.

In accordance with one aspect of the present invention, each game play event as defined hereinafter initiates an incremental increase in the progressive jackpot prize by a preset amount, and the total jackpot prize amount is displayed to the players in real-time manner to simulate the excitement and thrills typically associated with live casino games. The system and method of the present invention is simple to conduct, involves an attractive theme, and greatly enhances player convenience and ease of access, while helping to eliminate fraud, increase sales and maintain control over inventory.

As used herein, the term "progressive jackpot" or "progressive jackpot prize" represents a jackpot or highest payoff for a terminal device operated by a player where the value of the jackpot increases incrementally by a preset amount for a game playing event. In the present invention, a plurality of terminal devices are connected in an online environment through which various games may be played to form one progressive jackpot that grows in response to game playing events that occur during use of the plurality of terminal devices. The progressive jackpot of the present invention is initiated with a pre-established minimum starting jackpot which is premised on a game that is expected to generate sales to support the progressive jackpot in a manner acceptable to the game sponsor. The progressive jackpot increases until a player is selected to win the progressive jackpot prize. Once a player wins the progressive jackpot, the progressive jackpot resets to the pre-established minimum level. The incremental increases in the progressive jackpot is typically set by the game sponsor and will depend on the expected sales for supporting the progressive jackpot, the relative novelty of the progressive jackpots and game structure, the games associated with the progressive jackpots, and the like.

In one embodiment of the present invention, there is provided a method for playing an interactive game which comprises inputting into a source an access code, where the access code is operatively associated with game data, transmitting from the source a game play for play by a player on a terminal device in response to the inputted access code, and incrementally increasing the amount of a progressive jackpot in response to the occurrence of at least one game playing event.

As used herein, the terms "substrate", "game piece", "game card", "ticket", "token" and similar terms are intended to broadly refer to any medium which can display the access codes, and includes printed as well as "virtual" substrates that may be displayed on a display screen such as a cathode ray tube (CRT), liquid crystal displayer (LCD) or plasma display. Printed cards may be distributed at brick and mortar businesses which are typically characterized by a physical presence, and offer face to face consumer interaction such as, for example, convenience stores, grocery stores, pharmacies, newspaper stands, and the like, whereas virtual substrates are distributed in an online environment such as at Internet sites. The substrates can be awarded, given away or sold to the player.

The term "online environment" is intended to encompass any telecommunication network through which a player can interact with the present invention from a remote terminal device, which may be portable or located at a convenient place, and capable of supporting bi-directional data communication necessary for facilitating interactive activities. By way of example, the telecommunication network may be a cellular telephone network, a satellite television network, a cable television network, a wireless communication network, a Blackberry wireless data network, a public switched telephone network, a WiFi-based wireless data network, a computer network such as the Internet, a world wide web-based network, a wide area network, a local area network, and the like.

The term "terminal device" encompasses any communication and/or computer device having a display and a data input means for inputting data, and capable of receiving and transmitting data through a communication network for facilitating bi-directional communication. Such terminal devices include, but are not limited to, a personal computer, a cellular telephone, a personal digital assistant, a Blackberry wireless device, a laptop computer, an electronic tablet, interactive television, a video game device or any device furnished for implementing any form of communication and data service capable of maintaining an online environment.

The term "game" encompasses any structured or semi-structured contrived recreational activity where there is a goal that a player sets to reach and a set of rules concerning what the player can or cannot do to create the challenge and structure therein. Such games may be selected from games of chance, games of strategy, games of skill, and combinations thereof. Examples of games include, but are not limited to, board games, card games, word games, arcade games, puzzle games, casino games, children games, dice games, game show games, letter games, parlor games, pub games, tile-based games, and the like. The term "game play" is intended to mean a single game cycle or run represented by the initiation and completion of a particular game by a player.

Referring to FIG. 1, a hardware arrangement 10 is shown for one embodiment of the present invention. The hardware arrangement 10 includes an access code assigning computer 14, an access code database 12 for storing a plurality of access codes and corresponding game data, and a source or host computer 20 for implementing the interactive game method of the present invention including maintaining the progressive jackpot prize. The host computer 20 may be composed of one or more servers that operate in concert with one another to achieve the implementation of the present invention.

The host computer 20 is connected to a plurality of terminal devices 16 each operated by a player in an online environment through a telecommunication network 18, preferably over a public network such as, for example, over the Internet. A player can play a game including lottery/casino games through one of the terminal devices 16 contacting the host computer 20 after inputting a valid access code. The player may preferably use any one of a number of standard web browsers such as the Internet Explorer®, a product of Microsoft Corporation, Redmond, Wash., and the host computer is preferably compliant with a variety of web browsers.

The host computer 20 and the terminal devices 16 are typically comprised of one or more central processing units (CPU), various amounts of read only memory (ROM) and random access memory (RAM) storing computer programs and other data and other components typically found in computers. In addition, both the host computer 20 and the terminal devices 16 may include one or more monitors, fixed or removable data storage devices, and input devices such as mouse pointing devices, keyboards, touch sensitive screens, and the like, may be included.

Both the host computer 20 and the terminal devices 16 operate under the control of an operating system, such as Windows, Macintosh, UNIX, and the like. Furthermore, the host computer 20 and the terminal devices 16 each execute one or more computer programs under the control of their respective operating systems. The present invention is preferably implemented as one or more computer programs executed by the host computer 20, although in the alternative embodiments these computer programs may also be executed on the terminal devices 16.

Generally, the computer programs implementing the present invention are tangibly embodied in a computer-readable medium, e.g., one or more of the fixed and/or removable data storage devices attached to the host computer 20 and/or terminal devices 16. Under control of the operating system, the computer programs may be loaded from the data storage devices including ROM into the RAM of the computer for subsequent execution by the CPU. The computer programs comprise instructions which, when read and executed by the host computer 20 and/or terminal devices 16, causes the host computer 20 and/or terminal devices 16 to perform the steps necessary to execute the steps or elements of the present invention.

Those skilled in the art will recognize that the exemplary environment illustrated in FIG. 1 is not intended to limit the present invention. The hardware is conventional and forms no part of the present invention. Indeed, those skilled in the art will recognize that other alternative hardware environments may be used without departing from the scope of the present invention.

The access code assigning computer 14 generates a plurality of unique access codes each associated with game data, where a portion of the access codes is assigned to a series of substrates 19 (e.g., tickets or game pieces) for purchase by or distribution to a potential player. Each substrate 19 supports one or more access codes 17, which may be visible, or hidden under an opaque removable layer and subsequently revealed by the player to initiate a game. Optionally, the substrates 19 may further include a machine-readable code (e.g., a bar code, magnetic ink and/or smart card) for purposes of administering, controlling, tracking, and/or implementing an in-store award. A physical substrate or ticket is not required to obtain an access code. Alternatively, an access code can be obtained by purchase or distribution through the online environment via the terminal devices 16 to participate in a game. The access codes and game data generated by the access code assigning computer 14 are stored on a database 12 for subsequent access by the host computer 20.

The game data is established and assigned to each of the access codes prior to the distribution of the tickets or substrates in a given series or the distribution of the access codes via online payment transactions. The game data carries coding, preferably in the form of data tables, to store information associated with the corresponding access code and is not accessible by the player. The game data information may include, for example, the number of game plays available to the player, the predetermined outcomes of each game play, the prize structure including the type of prize awards for winning outcomes (e.g., zero prize awards, low tier prize awards, high tier prize awards, and progressive jackpot prize awards), the tally of prize awards won, and the like. In this manner, each of the selected access codes is assigned a prize structure covering all of the prizes that may be awarded.

The total payout for the prize structure and the number of prizes awarded for the total payout for the game may be predetermined. The generation of the access code and the corresponding game data take into account the prize structure during the course of the game. As to the progressive jackpot, the amount of the progressive jackpot, the break-even point of the jackpot which is the point at which if the players played for a sufficient period of time, the bets the players made would approximately equal the payoffs the player would receive to set the positive and negative expectations of winning, the odds and frequency of winnings, and the incremental increase in the progressive jackpot based on game playing events will depend in part on the revenue anticipated from the game. The use of the access codes in conjunction with the game data enables the game sponsor or operator to set up an appropriate prize distribution or schedule especially for fixed payout awards such as high tier and low tier prizes, and the progressive jackpot prizes. In this manner, the game sponsor is able to control the odds of the game and predict the profits from a full game in the event that all the access codes were to be sold.

Preferably, the determination of the progressive jackpot prize award may be made independently from the access code/game data. The progressive jackpot prize award determination may be implemented upon the progressive jackpot prize reaching a break-even point in terms of sales at which the terminal device operated by the player becomes a positive expectation bet for the player. When the progressive jackpot prize is less than the break-even point in terms of sales, there is a negative expected value or "house edge" for all players. In the long run, with optimal strategy, the game sponsor can make a profit.

In addition, the system of the present invention may make new prizes available based upon some outside event, for example, the passing of a certain time period assuming certain minimum sales, or the reaching of a certain level of game sales or revenue. Techniques known in the lottery industry can be applied to establish a set of access codes in the form of tickets or substrates with an appropriate distribution of prize awards.

Figure 2:
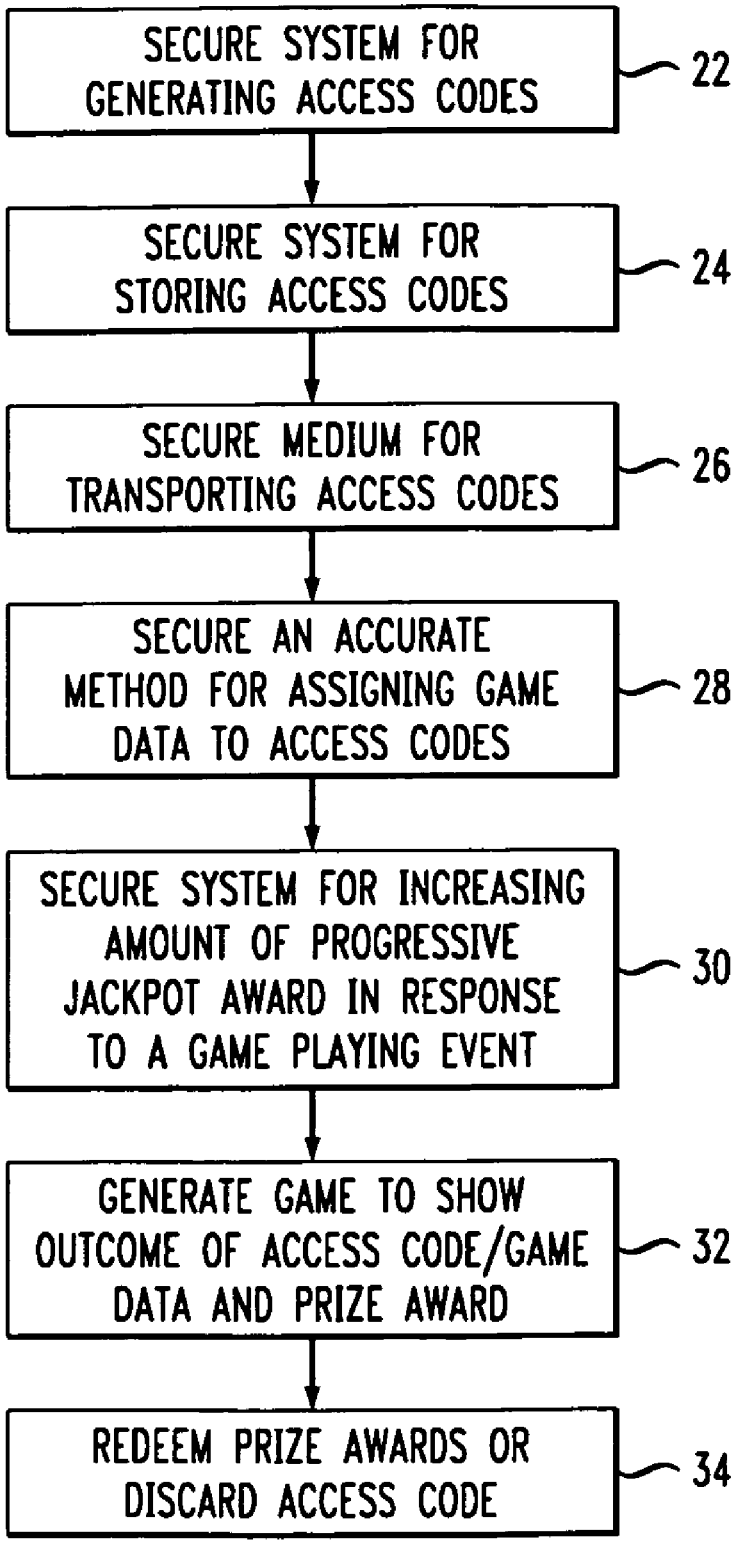
FIG. 2 is a block diagram of various components of a system for playing an interactive game in accordance with the present invention.

Referring to FIG. 2, the basic components of the interactive gaming system of the present invention is shown. The present gaming system includes a secure system for generating, controlling, and tracking the access codes and corresponding game data that enable the player to play a game as represented by block 22. The codes are referred to as "access codes" since the primary function is to provide the player access to the interactive gaming system of the present invention, in association with the game data which stores information regarding the outcome of the game played, for example.

The game data associated with each access code can, in addition, store other data that assists in the playing of the game, the tracking of the game, the security of the game, or any other data that may enhance the play of the game. The game data is maintained in secret from the player. If the player had access to the game data of the access code, the player would be able to determine if the access code contained a winning chance or a losing chance. Thus, the total and actual result of the game is encoded in the game data. By decoding the game data one may reveal whether or not a game was a winner or a loser, and if it was a winner, the prize won.

The present gaming system includes a secure system for storing the access codes and corresponding game data that enable the player to play a game as represented by block 24. The access codes are stored on the database 12 (as shown in FIG. 1) for implementation of the game. The system further includes a secure system for storing the access codes on a medium such as a substrate (e.g., ticket, game piece) as represented by block 26. In this component, the access code is stored on a substrate 19 (as shown in FIG. 1) for distribution to the player.

The process of storing the access codes on substrate depends on the form of substrate used. If, for example, the substrate is paper based, then the storing of the access code is implemented through printing. If the substrate is a computer, then the storage of the access code includes magnetic or laser optical storage media. As used herein, the terms "substrate", "game media" and "gaming piece" include, but are not limited to, tickets, coupons, game pieces, packaging, cards, magnetic storage media, and laser optical storage media. Characteristic of all gaming pieces utilized with the present invention are that the substrate includes the access code stored thereon, either by printing, magnetics, or an integrated circuit memory device.

Once an access code is generated and stored, a player may acquire that access code and use the code in the play of a game. Since the access code is operatively associated with game data for storing the outcome of the game, the access code and game data is processed to determine the outcome of the game when played by the player. Block 28 indicates the component for reading the game data of the associated access code to decode predetermined outcome or result of the game.

The present gaming system further includes a secure system for increasing the amount of a progressive jackpot prize in response to a game playing event as represented by block 30. The terminal devices 16 (as shown in FIG. 1) controlled by the players are operatively linked to together through playing of games to contribute to the progressive jackpot at the same time. This increase of the progressive jackpot by a pre-set amount is triggered by at least one game playing event occurring at the initiation and/or during the playing of a game by the player. The game playing event may include, for example, the initiation or completion of a game by the player, a time interval after initiation of the game, an appearance of special game symbol or indicia in a game, combinations thereof, and the like. Once a player wins the progressive jackpot prize award, the progressive jackpot prize resets to a preset minimum level.

Using the access code, a player is now allowed to play a game as represented by block 32. The purpose of the game is to display, in a pleasing fashion, the actual prize that is stored in the game data associated with the access code and to display the game results as though there is a completely random element but where the outcome of the game is predetermined. If the game data of the access code indicates that the player wins, then the system proceeds to select and display game symbols or indicia to furnish a winning result. Conversely, if the game data of the access code indicates that the player loses, then the system proceeds to select and display game symbols or indicia to furnish a losing result, so the player will view a losing game.

Alternatively, the present interactive gaming system can be configured to randomly generate the outcome of the game at the time the player initiates the game. The randomly generated outcome can be coordinated through a set of mathematically-determined odds to ensure that the game sponsor retains a predictable long-term advantage over the players in a manner similar to or the same as live casino games such as slot machines, craps, roulette, baccarat, blackjack, poker and the like. For example, the progressive jackpot winner may be determined in a random mode that is dependent on the progressive jackpot reaching a break-even point which is the point at which if the players played for a sufficient period of time, the bets the players made would approximately equal the payoffs the player would receive. In this manner, when the break-even point is reached, a particular terminal device becomes a positive expectation bet for the player. Conversely, when the progressive jackpot is less than the break-even point, there is a negative expected value (house edge) for all players as known in the art of progressive jackpots.

The present gaming system includes a secure system for redeeming the prize award as represented by block 34. In one embodiment, a player may bring the substrate 19 to a redemption and verification system in order to verify the validity of the substrate 19 and the access code to receive payout of the prize award, if the player has won. Alternatively, the player can print out a voucher coupon from the terminal device 16 documenting the prize award and present the voucher coupon to the redemption and verification system. In a further alternative, the player can redeem the prize award through existing electronic fund transfer (EFT) methods or by having the prize award forwarded, for example, by a check payment through the postal service.

Figure 3:
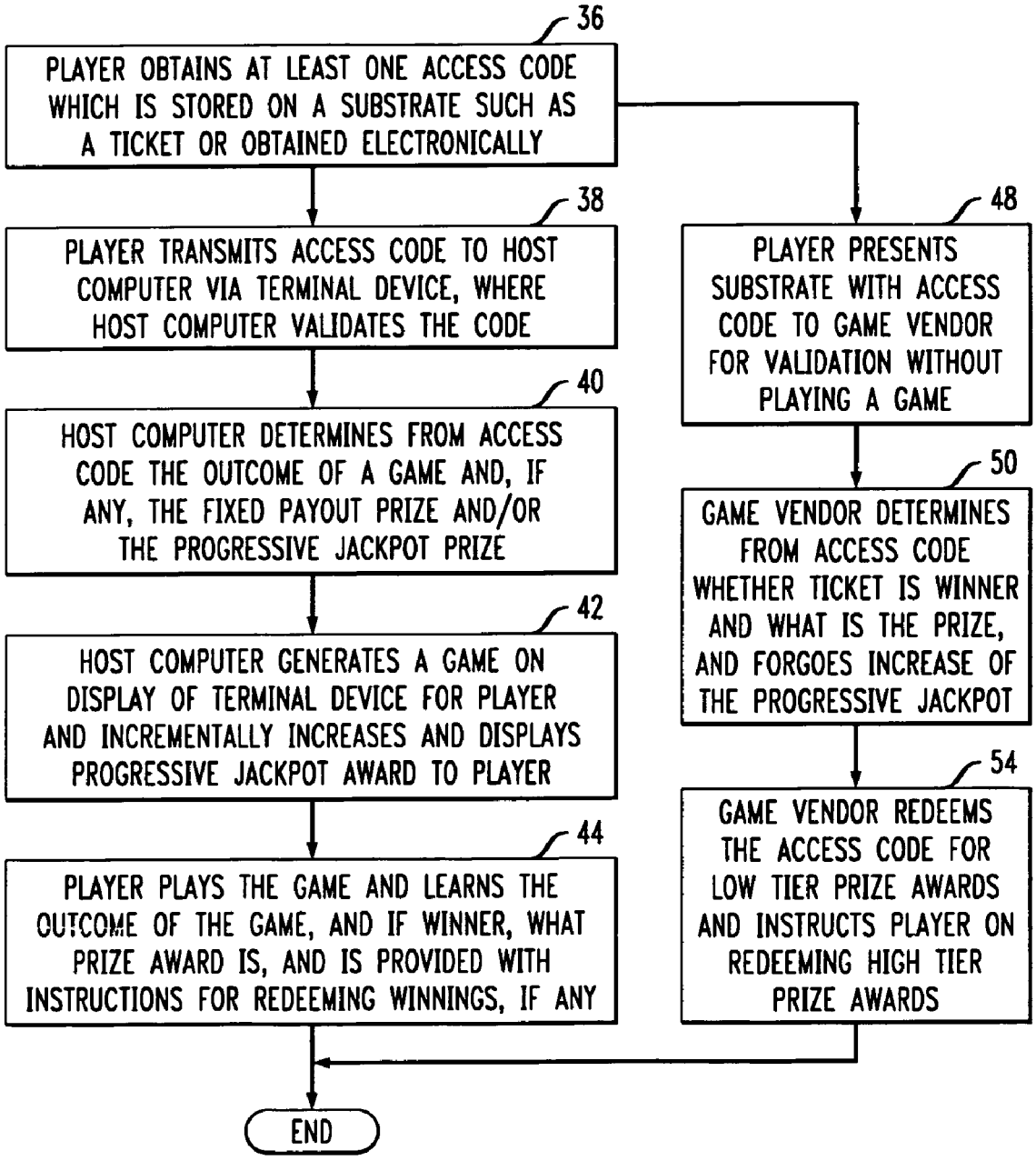
FIG. 3 is a block diagram of various steps of a method for playing an interactive game in accordance with the present invention.

Referring to FIG. 3, various steps of the interactive gaming system is shown for one embodiment of the present invention. This system allows a player to obtain or acquire at least one access code stored on a substrate or obtain the access code through the terminal device in step 36. The player may purchase the access code through the terminal device using existing known electronic payment transactions including, for example, debit or credit card transactions. Thereafter, the access code is transmitted to the host computer. The access code may be transmitted manually by having the player input the access code through a terminal device such as, for example, a personal computer or a cellular phone over a communication network connection such as the Internet. Once received, the host computer proceeds to validate the access code in step 38. The player is offered a choice of different games available for play, and the player may select the type of game to play in this step.

Once the access code is validated and acknowledged to be unused, the host computer reads the game data associated with the access code to determine the outcome of the game and the corresponding prize award (i.e., high tier prize, low tier prize or progressive jackpot award) in step 40. The host computer with the information from the game data proceeds to generate a game with the predetermined outcome and incrementally increases the amount of the progressive jackpot prize for display on the terminal device of the player in step 42. The player plays the displayed game and learns of the outcome including the prize, if any, in step 44. In this step, instructions on redeeming the prize award may be provided to the player.

Alternatively, the player can check to determine if the access code is a winner without playing a game on a terminal device. By forgoing the play of the game via a terminal device, the player forfeits any chance to win the progressive jackpot prize or anything more than the minimum progressive jackpot prize, and is limited to a fixed payout prize such as a high tier or low tier prize. In addition, since the preset incremental increases in the progressive jackpot are dependent on a game playing event, failure to play the game will forfeit any increase in the progressive jackpot prize. Here again, the present invention is similar to live casino play where the possibility of winning a progressive jackpot is predicated on playing the casino game associated with a progressive jackpot.

The player, upon obtaining the access code in step 36, may proceed to present the access code to a game vendor for validation in step 48. The game vendor determines from the access code and game data the outcome of the access code and the prize in step 50. The game vendor can redeem the access code for low tier prize awards, and instruct the player on redeeming high tier prize awards at a redemption center in step 52.

Figure 4:
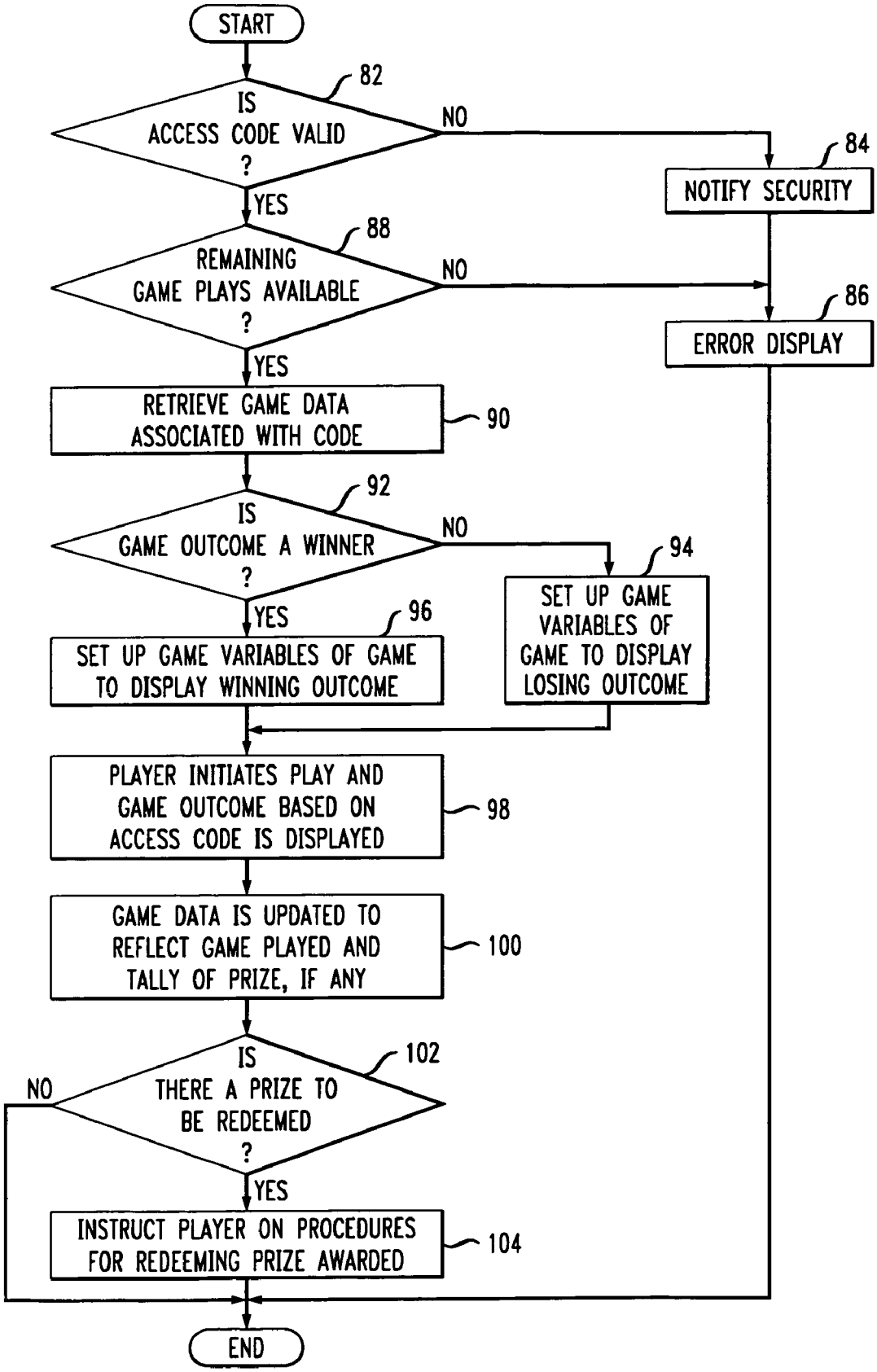
FIG. 4 is a flow chart illustrating the implementation of an access code for generating a game in accordance with the present invention.

Referring to FIG. 4, a flow chart illustrating the implementation of an access code for generating a game is shown in accordance with the present invention. The access code may be coupled with game data that provides multiple game plays for each code, thereby allowing the player to play multiple times. The host computer of the interactive gaming system reads the access code inputted by the player via a terminal device. The host computer checks to determine if the access code is valid in step 82. If the access code is invalid, the host computer proceeds to notify security of a possible tampering or fraud attempt at step 84, and generates an error display on the terminal device in step 86 prior to exiting. If the access code is determined to be valid by the host computer, the host computer proceeds to check to determine if the access code has been played previously (i.e., no remaining game plays available) in step 88. If no remaining game plays are available with the access code, the host computer generates an error display on the player's terminal device in step 86 and exits.

If there are remaining game plays are available with the access code, the host computer retrieves the game data associated with the access code in step 90. The information contained in the game data may represent, for example, the number of game plays available to the player, the predetermined outcomes of each game, the type of prize awards for winning outcomes (e.g., zero prize awards, low tier prize awards, high tier prize awards, and progressive jackpot prize awards), the tally of prize awards won, and the like. In step 92, the host computer determines from the game data if the game is a winning game.

If the game is not a winning game, the host computer sets up the game for display to lose in step 94, and proceeds to step 98 to allow the user to play the game. If the game is a winning game, the host computer sets up the game for display to win in step 96, and proceeds to step 98 to allow the user to play the game. In step 98, the player learns of the outcome of the game. In step 100, the host computer updates the game data deducting one game play from those remaining, and tallies any prize award won, and the updated game data is saved in the database of the host computer.

Figure 5:
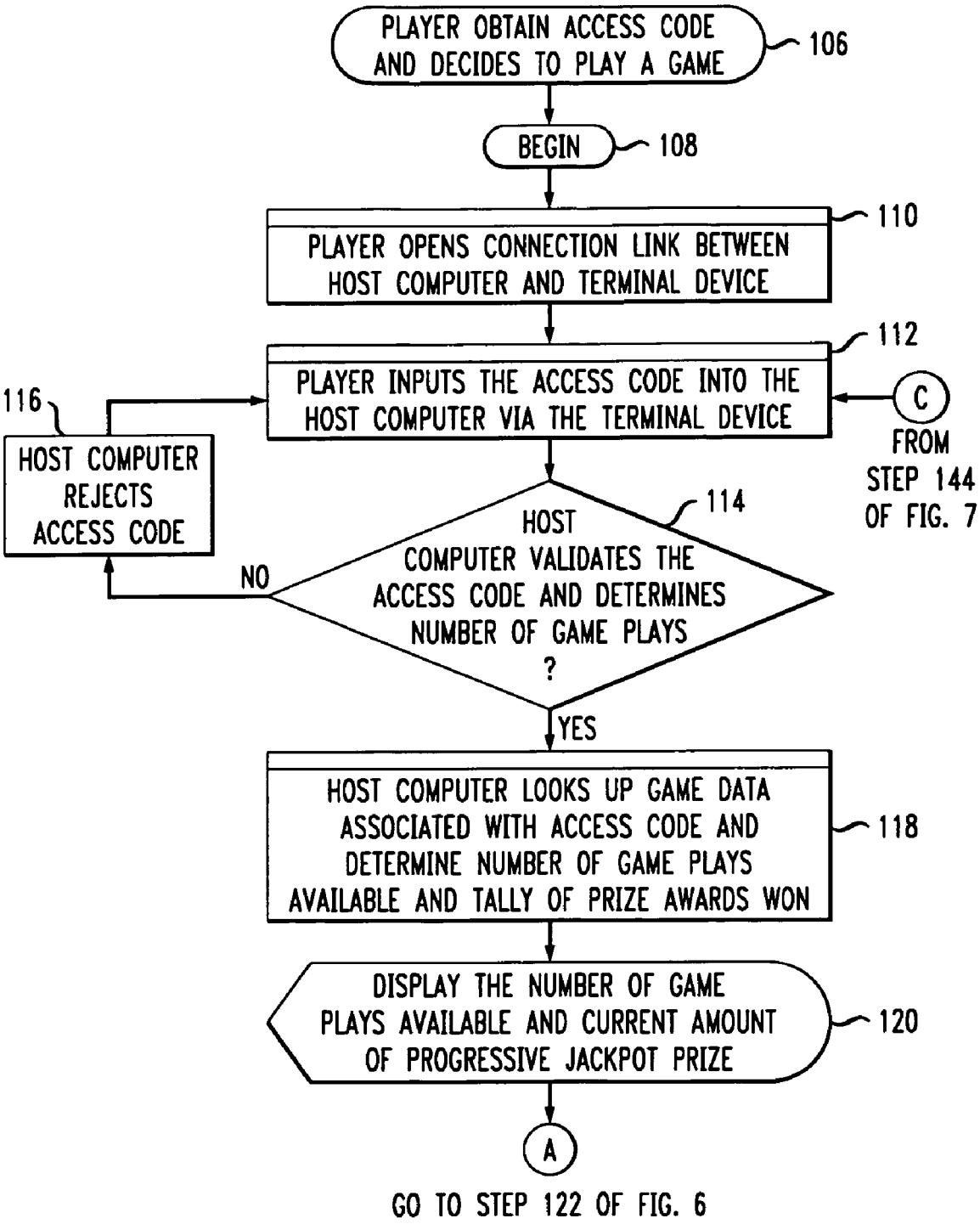
FIGS. 5 to 7 are flow charts illustrating the operation of the system for playing an interactive game to exemplify a further embodiment of the present invention.
Figure 6:
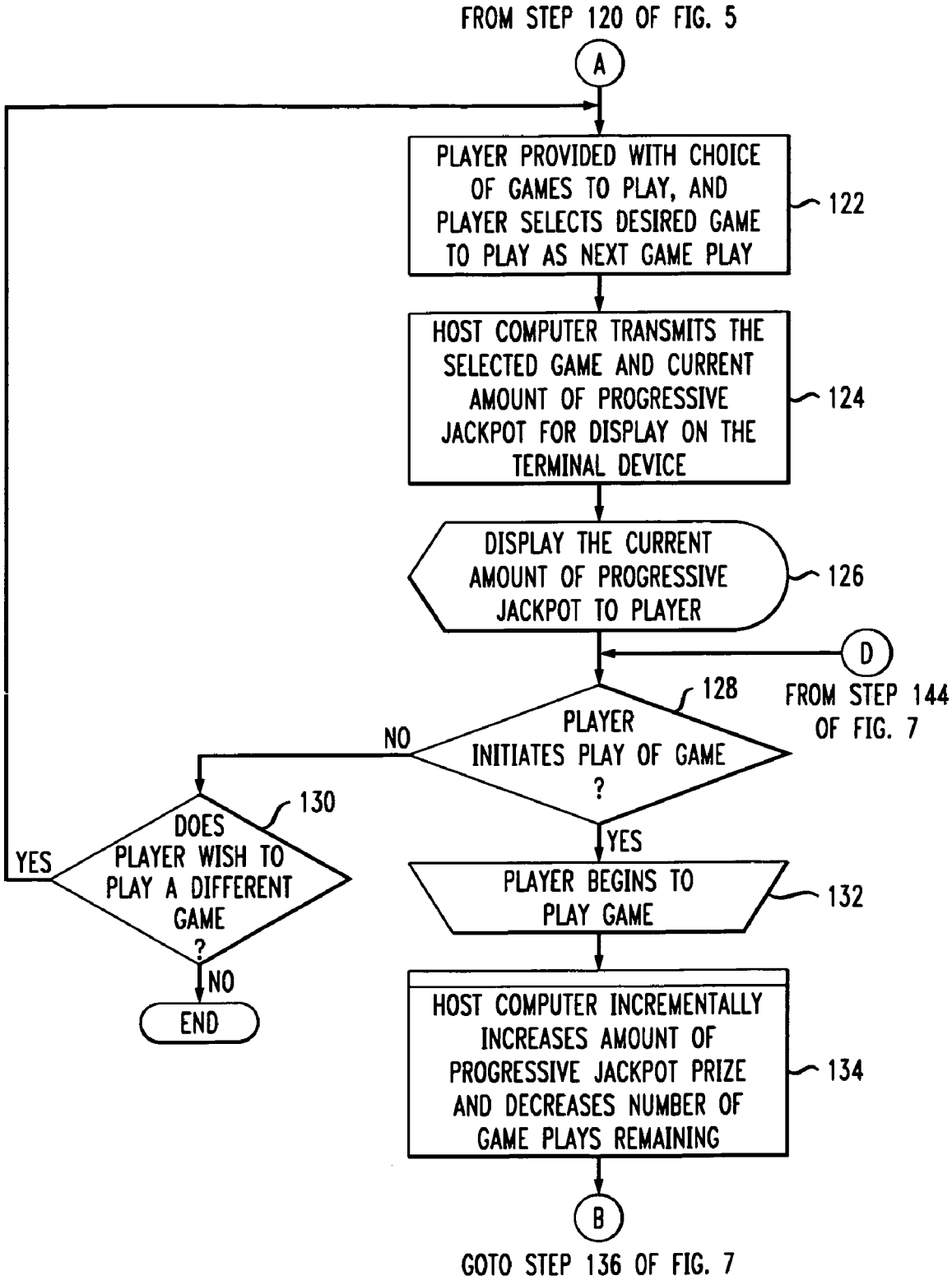
Figure 7:
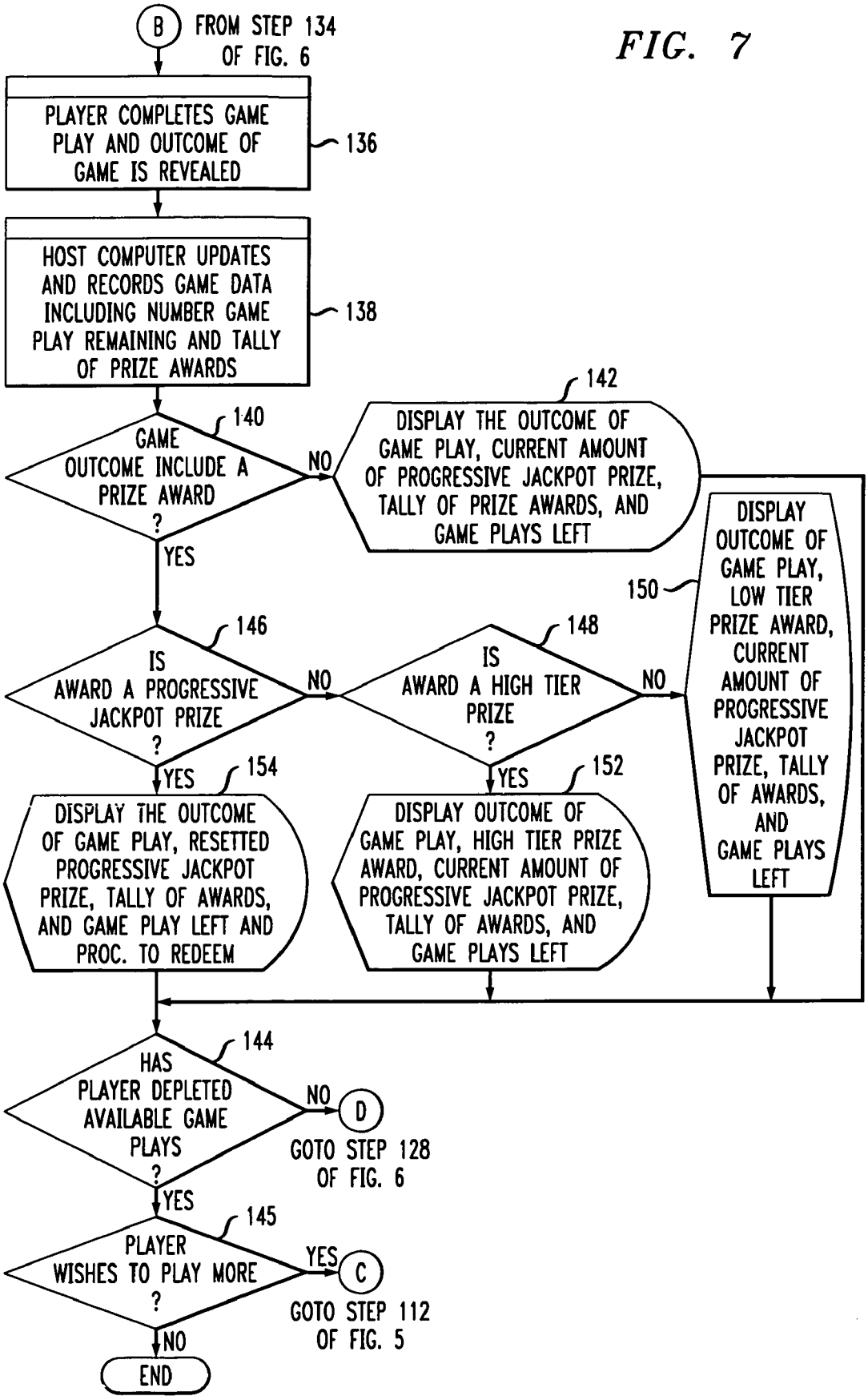

Referring to FIGS. 5 to 7, flow charts are shown illustrating more detailed operation of the interactive gaming system for exemplifying a further embodiment of the present invention. The method begins at the begin block 108 after the player acquires the access code and decides to play the games on a terminal device 16 at step 106. The player opens a connection between the terminal device 16 and a host computer 14 programmed with a software program suitable for implementing the interactive gaming system of the present invention via a communication network 18. The software program requests the access code from the player in step 112. In order for the player to access the software program, the player is required to enter a valid access code. The access code is operatively associated with game data specific to the access code.

The game data includes encoded control information for security, such as, for example, manufacturer's code, lot number, game types or selections available for play, version number of the games and information; and program information, such as, for example, whether the program is a winning game or a losing game; the amount of prize won; the minimum prize for this game; the maximum prize for this game; and related game details. The game data may further store the number of times the access code was played, information about prizes collectively won by the player, information about the player's habits during play, and general information as to what has transpired during the game.

At step 114, the software program checks to determine the validity of the access code, and the number of game plays available or remaining. If the access code fails or the number of game plays is zero, then the software program rejects the inputted access code at step 116 and requests an access code again at step 112. This loop may be expanded by adding a feature that after a certain number of entries of the access code, the player is locked out from the host computer as a precaution against potential fraud.

If the access code is valid, the software program proceeds to look up the game data to determine the number of plays available or remaining and the tally of prize awards won in step 118. As discussed previously, the game data carries coding, preferably in the form of data tables, to store information associated with the corresponding access code and is not accessible by the player. This information may represent, for example, the number of game plays available to the player, the predetermined outcomes of each game play, the type of prize awards for winning outcomes (e.g., zero prize awards, low tier prize awards, high tier prize awards, and progressive jackpot prize awards), the tally of prize awards won, and the like.

Once the software program retrieves the information related to the number of plays available or remaining, and the tally of prize awards won, the information is displayed along with the current progressive jackpot prize to the player at step 120. In a preferred embodiment, the progressive jackpot prize is displayed throughout the player access and continuously updated in real-time manner to increase the excitement and thrill of the gaming experience. Additionally, an introduction screen may be displayed for providing information, including, for example, descriptions and sample screens of different games that are available. The software program anticipates input from the player at step 120. Once it receives the input, the software program proceeds to step 122 to display the main game menu and to allow for game selection. Once the player selects a game for implementing the next game play, the software program transmits the start screen of the selected game and the current amount of the progressive jackpot prize at step 124.

At step 126, the progressive jackpot prize is prominently displayed to the player. The software program queries the player in step 128 as to whether the player wishes to begin the game play. If the player declines, the software program queries the player in step 130 as to whether the player wishes to play a different game. If the player declines, the software program ends. If the player wishes to play a different game, the software program proceeds to step 122 to display the introduction screen to allow the player to select a different game.

If the player is satisfied with the selection of the game, the software program requests the player to press the launch key to initiate the game play at step 132. Once the game play is initiated, the software program proceeds to increase the progressive jackpot prize in response to at least one game playing event, and decrease the number of game plays available or remaining by one at step 134. The game playing event triggers an incremental increase in the progressive jackpot prize, and is intended to encompass one or more events that may occur during the playing and/or initiation of a game by the player. The game playing event may include, for example, the initiation or completion of a game by the player, a time interval after initiation of the game, an appearance of special game symbol or indicia in a game, combinations thereof, and the like.

At step 136, the software program generates the game for the player and incorporates the outcome of the game play into the initiated game based on the game data. Once the player becomes aware of the outcome of the game play, the software program updates the game data including information corresponding to the game plays remaining and the tally of the prize awards won at step 138. The software program determines whether a prize award has been won by the player in step 140. If the player wins nothing, the software program displays the current amount of the progressive jackpot prize, the tally of prize awards won, and game plays remaining at step 142.

The software program then determines if there are game plays remaining at step 144. If there are no game plays remaining, the software program proceeds to step 145 and queries whether the player wishes to play more games. If the player declines, the system ends. If the player accepts, the system proceeds to step 112 of FIG. 5 where the player is requested to input a new access code. If there are game plays still available, the software program proceeds to step 128 of FIG. 6 where the player can decide to play again.

If the player wins a prize award, the software program proceeds to step 146 and determines whether a progressive jackpot prize has been awarded. If the player did not win the progressive jackpot prize, then the software program determines whether the player has won a high tier prize at step 148. If the player did not win the high tier prize at step 148, the software program proceeds to step 150 and the software program displays the low tier prize award, the current amount of the progressive jackpot award, the tally of prize awards won, and game plays remaining at step 150.

The software program then determines if there are game plays remaining at step 144. If there are no game plays remaining, the software program proceeds to step 145 and queries whether the player wishes to play more games. If the player declines, the system ends. If the player accepts, the system proceeds to step 112 of FIG. 5 where the player is requested to input a new access code. If there are game plays available, the software program proceeds to step 128 of FIG. 6 where the player can decide to play again.

If the player did win the high tier prize award at step 148, the software program proceeds to step 152 and the software program displays the high tier prize award, the current amount of the progressive jackpot prize, the tally of prize awards won, and game plays remaining at step 152.

If the player wins a prize award, the software program proceeds to step 146 and determines whether a progressive jackpot prize has been awarded. If the player did win the progressive jackpot prize award, then the software program proceeds to step 154 and displays the winning progressive jackpot prize award, the current amount of the progressive jackpot award upon reset to the pre-established minimum amount, the tally of prize awards won, and game plays remaining at step 154.

The software program then determines if there are game plays remaining at step 144. If there are no game plays remaining, the software program proceeds to step 145 and queries whether the player wishes to play more games. If the player declines, the system ends. If the player accepts, the system proceeds to step 112 of FIG. 5 where the player is requested to input a new access code. If there are game plays available, the software program proceeds to step 128 of FIG. 6 where the player can decide to play again.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A method for playing an interactive game comprising:

(a) inputting into a source an access code, said access code operatively associated with game data;

(b) transmitting from the source a game play for play by a player on a terminal device in response to the inputted access code; and (c) increasing the amount of a progressive jackpot in response to the occurrence of at least one game playing event, wherein the amount of the progressive jackpot increases incrementally by a preset amount for a game playing event and the amount of the progressive jackpot to be awarded to a player is determined independent of the access code or game data.

2. The method of claim 1 wherein the source is a host computer.

3. The method of claim 1 wherein the game playing event comprises initiation of the game play by the player on the terminal device.

4. The method of claim 1 wherein the game playing event comprises a time interval subsequent to initiation of the game play by the player on the terminal device.

5. The method of claim 1 wherein the game playing event comprises generation of predetermined symbols corresponding to the game play.

6. The method of claim 1 wherein the access code is embodied on a substrate.

7. The method of claim 6 wherein the substrate is selected from the group consisting of tickets, coupons, game pieces, packaging, cards, magnetic storage media, and laser optical storage media.

8. The method of claim 1 further comprising furnishing the access code to the player.

9. The method of claim 8 wherein the access code is furnished via the terminal device.

10. The method of claim 1 wherein the game data comprises:

a number of game plays remaining for the access code;

predetermined outcome and a corresponding prize award of each game play for the access code; and a tally of prize awards won of the game plays played for the access code.

11. The method of claim 10 further comprising indicating to the player the outcome of the game play and the corresponding prize award based on the game data for the access code.

12. The method of claim 11 further comprising updating the game data as to the number of game plays available and the tally of the prize award won after each game play.

13. The method of claim 1 further comprising furnishing a selection of games for the player choose to play.

14. The method of claim 10 wherein the prize award is selected from a prize structure.

15. The method of claim 14 wherein the prize structure is selected from the group consisting of a fixed prize, a progressive jackpot prize and combinations thereof.

16. The method of claim 15 wherein the fixed prize is selected from a high tier prize or a low tier prize.

17. The method of claim 15 wherein the progressive jackpot prize comprises a preset minimum amount.

18. The method of claim 17 wherein the preset minimum amount is greater than the high tier prize.

19. The method of claim 1 wherein the terminal device comprises a display and means for inputting data from the player to the host computer.

20. The method of claim 19 wherein the terminal device is selected from the group consisting of a personal computer, a cellular telephone, a personal digital assistant, a Blackberry wireless device, a laptop computer, an electronic tablet, and a video game device.

21. The method of claim 1 comprising:

determining the outcome of the game play; and displaying the outcome of the game play to the player.

22. The method of claim 21 wherein the outcome determining step comprises randomly selecting the outcome of the game play.

23. The method of claim 21 wherein the game data comprises a predetermined outcome of the game play.

24. The method of claim 23 wherein the outcome determining step comprises reading the game data.

25. A system for playing an interactive game, comprising:

(a) an access code operatively associated with game data;

(b) inputting means for inputting into a terminal device the access code to initiate a game play for display on the terminal device;

(c) means for transmitting the game play from a source to the terminal device; and (d) game play initiation means for initiating a game play; and (e) progressive jackpot increasing means for increasing the amount of the progressive jackpot in response to the occurrence of at least one game playing event, wherein the amount of the progressive jackpot increases incrementally by a preset amount for a game playing event and the amount of the progressive jackpot to be awarded is determined independent of the access code or game data.

26. The system of claim 25 wherein the progressive jackpot increasing means comprises means for incrementally increasing the amount of the progressive jackpot.

* * * * *